United States Patent [19]

Grant

[11] Patent Number: 4,953,886

[45] Date of Patent: Sep. 4, 1990

[54] MOBILE STRETCHER SUPPORT

[76] Inventor: Fred W. Grant, 3177 Terrace Ct., Apt. H, Norcross, Ga. 30092

[21] Appl. No.: 382,911

[22] Filed: Jul. 21, 1989

[51] Int. Cl.[5] ..... A61G 1/00

[52] U.S. Cl. ..... 280/640; 280/47.11; 280/87.01; 296/20; 5/82 R

[58] Field of Search ..... 280/640, 641, 47.11, 280/47.34, 47.371, 87.01; 296/20, 19; 5/82 R

[56] References Cited

U.S. PATENT DOCUMENTS

| | | | |
|---|---|---|---|
| 820,026 | 5/1906 | Stokes | 5/82 R |
| 1,109,083 | 9/1914 | Saltis | 296/19 |
| 2,276,256 | 3/1942 | Visness et al. | 5/82 |
| 2,580,410 | 1/1952 | Cummiskey | 5/82 |

FOREIGN PATENT DOCUMENTS

| | | | |
|---|---|---|---|
| 789577 | 10/1935 | France | 296/20 |

*Primary Examiner*—David M. Mitchell
*Attorney, Agent, or Firm*—Thomas & Kerr

[57] ABSTRACT

An emergency hand truck for evacuating injured or wounded personnel has an elongated frame to which are mounted wheels, and litter support means is mounted approximately at each corner of the frame. The litter support means is adapted to receive the handles of a stretcher or body board, and has a curved surface adapted to support a Stokes basket type of litter.

10 Claims, 2 Drawing Sheets

MOBILE STRETCHER SUPPORT

TECHNICAL FIELD

This invention relates to hand trucks and, more particularly, emergency hand trucks for evacuating injured or wounded personnel.

BACKGROUND OF THE INVENTION

In catastrophic situations, such as earthquakes, fires, explosions, and, particularly military situations, such as actual battlefield combat, the removal of injured or wounded personnel is often restricted or curtailed by the lack of sufficient manpower to carry the injured from the scene of the emergency to where they may obtain medical treatment. Similarly, in sports such as skiing, an accident may occur at a relatively inaccessible location, and removing the injured person becomes a definite problem.

Heretofore, such devices as stretchers, body boards, and Stokes baskets have been used to remove the patient from the scene. In the case of stretchers and body boards, at least two, and preferably four, people are required to transport the stretcher or board and the patient. The Stokes basket is usually lifted and transported by a helicopter, for example, or, when used at sea, by an arrangement similar to a breeches buoy, for transfer between ships. Obviously, none of these is completely satisfactory since sufficient personnel may not be available to carry the litter (by "litter" is meant any of the various devices, including stretchers, body boards, Stokes baskets, and the like) or a helicopter or other lifting means may not be available. In addition, the degree and type of trauma is often determinative of the type of litter to be used, and hence the means of transporting. Thus severe back or neck injuries, for example, almost invariably require a body board to immobilize the patient, thus further requiring sufficient personnel to transport the board and patient.

In most cases heretofore, then, there have been, or there exists the possibility of problems in evacuating the litter and patient from the scene, which problems are compounded when the scene is in a remote area difficult to access.

Accordingly, it is an object of the present invention to provide transportation for a patient regardless of the type of litter.

It is another object of the invention to provide such transportation without requiring numerous personnel or other means, such as helicopters or other lifting means for removing the patient or otherwise readily deliverable.

It is still another object of the invention to overcome the problems of remote or otherwise inaccessible locales by being air-dropable, for example.

SUMMARY OF THE INVENTION

The foregoing objects of the invention are achieved in a preferred embodiment thereof which comprises a hand truck or cart comprising an elongated flat frame member having front and rear sections and having ;;heels at the front and rear thereof. The front wheels are mounted on a swivel arrangement for steering with a swivelly mounted handle by which the cart can be pulled by a single person. Four angularly disposed elongated flat plates are mounted at one end to the frame member approximately at the corners thereof while the other or distal end of each plate terminates in an upstanding support arm adapted to receive a handle of a litter. Thus a litter having four handles can be supported above the truck frame by the four plates and upstanding support arms.

Affixed to the flat plates and extending from each upstanding support arm toward the end of the plate mounted to the frame is a support plate having a concave upper edge curving downward and away from the support arm. The curvature of the plate is such that the curved sides of a Stokes basket fit therein, thrls support is provided for such a basket or similar device.

The arrangement of the invention can adapt to variations in dimensions of the various litter devices when the ends of the elongated flat plates are swivelly mounted to the frame. Such swivel mounting nonetheless supplies fixed support for the litter when it is placed thereon, either in the support arms or resting on the curved support plate.

The frame member is transversely hinged approximately midway between the front and rear wheels so that the truck may be folded up, thereby dividing it into front and rear sections, into a closed configuration thereby enhancing its transportability and facilitating its air drop capability. When the truck is unfolded, locking means are provided for insuring rigidity of the truck frame. The frame is further provided with a plurality of cleats for strapping the litter and the patient to the truck, which is especially desirable in rough terrain.

At the rear of the frame is a foldable handle to facilitate pushing of the truck, and likewise, in hilly terrain, to provide an added measure of control of the truck.

BRIEF DESCRIPTION OF THE DRAWINGS

The features and advantages of the present invention are made readily apparent in the following detailed description, read in conjunction with the drawings, in which.

DETAILED DESCRIPTION

Figure 1:
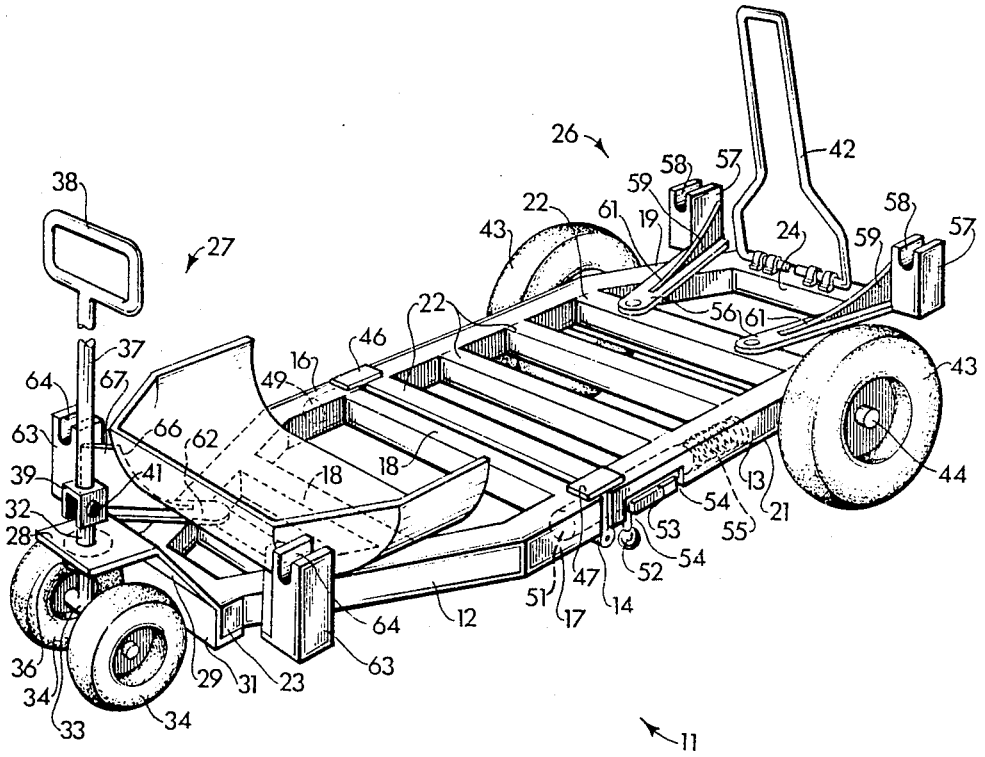
FIG. 1 is a perspective view of the hand truck of the invention, depicting the front end of a Stokes basket type litter in place.

In FIG. 1 the hand truck 11 of the present invention comprises an elongated frame having a front section 12 and a rear section 13, which are hinged together by a transverse piano type hinge 14, which will be discussed more fully hereinafter.

Section 12 comprises first and second side members 16 and 17 which are joined by a plurality of transversely extending strength members 18, 18 welded or otherwise attached thereto, and, in like manner, section 13 comprises first and second side members 19 and 21, joined by strength members 22, 22. Frame section 12 tapers from its widest transverse dimension to a much narrower width at the front thereof, and terminates in transverse end member 23. Frame section 13 likewise tapers toward the rear of the truck and terminates in transverse end member 24. It can be seen that there is a relatively large open space 26 between the rearmost member 22 and end member 24, bounded on either side by the tapered portions of frame section 13.

As thus far described, the components forming the frame are of any suitable material, such as, for example, one and one-half inch square hollow steel tubing, with the various components being welded together. Other materials, such as certain plastics, could also be used provided such materials possess sufficient strength and rigidity. For simplicity, the ensuing discussion of the invention will relate to a steel structure.

Mounted to the front of section 12 is a wheel assembly support bracket 27 comprising a flat plate 28 from the rear edge of which a tapered plate 29 depends. Plate 29 terminates in a transversely extending L-shaped bracket 31 which is welded to end member 23.

A wheel assembly comprising a vertical shaft 32 and transverse axle 33 to which is mounted a pair of wheels 34, 34 is mounted to plate 28, with shaft 32 being free to turn relative thereto by means of a swivel mount 36 on the underside of plate 28. Mount 36 may be any of a number of commercially available swivels, preferably, although not necessarily, of the ball bearing type, thereby making the wheel assembly easy to turn. Control of the turning of the wheel assembly is realized by a shaft 37 which terminates at one end in a hand grip 38 and which is swivelly mounted at its other end to the top, free end of shaft 32 by means of a clevis 39 and pin 41. Thus, shaft 37 and hand grip 38 function as a steering mechanism as well as a truck or cart pulling mechanism. When not in use, shaft 37 may be swiveled back and down to rest against front section 12 of the frame. Swivelly attached to the top of rear end member 24 is a foldable handle 42 which provides an additional measure of control of truck 11, especially when it is moving downhill, where handle 42 can serve as a restraint. When not in use, handle 42 can be folded down to rest against frame section 13.

At the rear of truck 11 is mounted a pair of wheels 43, 43 affixed to axle 44, which in turn is mounted to the underside of a transverse member 22. It is to be understood that, if desired, various spring and/or shock absorber arrangements could be used in mounting the wheels and axle to the truck, but, for simplicity, such elements have not been shown. Wheels 34, 34 could likewise be mounted to suitable shock absorbing means. It is preferable that wheels 34, 34 and 43, 43 be balloon tired for absorbing some of the bumps resulting from an irregular terrain.

As was pointed out heretofore, sections 12 and 13 are hinged together by means of a transverse piano hinge 14, so that truck 11 may be folded, with section 12 moving in the direction of the arrow, so that the wheels 34, 34 will be accommodated in the open space 26. The folded truck is easier to transport, as by airplane, since it is a relatively compact structure. When the truck 11 is unfolded, keeper plates 46 and 47, welded to the tops of side members 16 and 17, respectively, prevent front section 12 from swinging past the horizontal. Plates 46 and 47, which bear against side members 19 and 21 when the truck 11 is fully opened, serve to strengthen the hinged joint by relieving hinge 14 of much of the load bearing function.

In order to lock truck in its open position, barrel bolts 49 and 51, shown in dashed outline are provided in the form of, for example, one inch diameter steel rods which ride in the side members 16, 19, 17, and 21. Bolt 51 is actuated by a lever arm 52 which rides in horizontal slot 53 in side member 21. Each end of slot 53 terminates in a downwardly extending slot 54 for locking actuating arm 52 and hence bolt 51 in the forward, locked position, with bolt 51 extending into member 17, or in its rearward locked position, with bolt 51 withdrawn from member 17. The actuating and locking arrangement for bolt 49, which is not shown, is the same.

A pair of elongated flat plates 56, each plate being mounted at one end to the rearmost strengthening member, project outwardly at an angle to the member 22 to define the rear corners of the litter bearing mechanism. The distal end of each plate 56 has mounted thereto an upwardly extending support arm 57 which has a U-shaped notch 58 at the top thereof. It can be seen that arm 57 is at an angle to plate 56 so that the axis of notch 58 is roughly parallel to the longitudinal axis of the truck 11. Extending from arm 57 toward the mounted end of plate 56 is a support plate 59, the upper edge 61 of which has a concave shape extending down and away from arm 57. The curvature of edge 61 is preferably chosen to approximate the curvature of the sides of a Stokes basket, it not being necessary for it to exactly match the basket curvature.

At the front of the truck 11 are a second pair of elongated flat plates 62, only one of which can be seen in FIG. 1, likewise mounted at one end to a strengthening member 18, and each one having a support arm 63 with a U-shaped notch 64 at the top thereof and defining the forward corners of the litter bearing arrangement. Extending from each arm 63 and having a concave upper edge 66 is a support plate 67 for a Stokes basket, a portion of which is shown. Where a stretcher or body board is to be carried by truck 11, the handles are placed in the notches 58 and 64. To accommodate variations in spacing of the handles, notches 58 and 64 are made substantially wider than a stretcher handle diameter. However, the adaptability to differences in spacing is limited. A greater degree of adaptability can be achieved by swivelly mounting support plates 56 and 62 to the truck. With the swivel arrangement, greater variations in handle spacing can be accommodated, and just as importantly, different curvatures of Stokes baskets, within limits, can be supported. With a swivel arrangement, when the litter is in place, the plates 56 and 62 are unable to swivel, thus providing rigid support for the litter.

Figure 2:
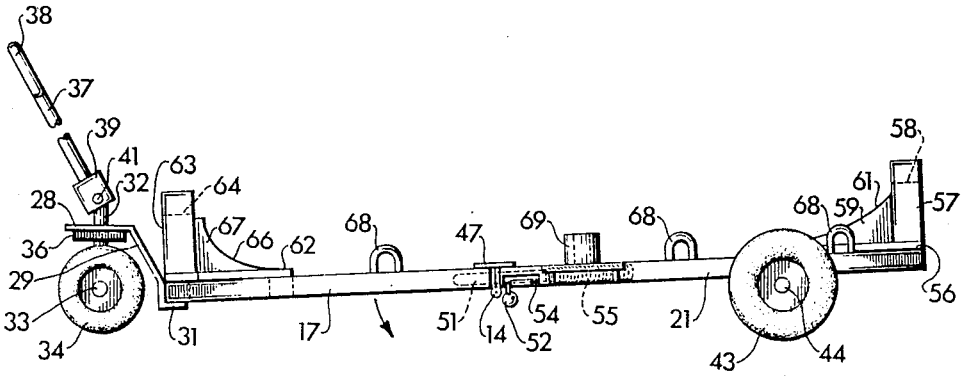
FIG. 2 is a side elevational view of the hand truck of the invention.

In FIG. 2 bolt 51 is shown in dashed lines in its forward or truck open locking position, and lever 52 is in forward slot 54. If desired, bolt 51 may be provided with a spring bias from a coil spring 55, shown in dashed lines in FIG. 2. Spring 55 functions to hold bolt 51 in its forward locked position in the event that lever 52 is shaken free of slot 54 by the rough terrain. It can be seen that hinge 14 is in the way of bolt 51, hence it is necessary to form a cut-out in hinge 14 to clear bolt 51, or else hinge 51 may extend from the inside edges of members 17, 21 and 16, 19.

In FIG. 2 is can be seen that axle 44 is slightly higher than axle 33, and wheel 45 is larger than wheel 34. This has the effect of elevating the rear of truck 11 so that the sections 12 and 13 are angled downward from rear to front. The advantage of this arrangement is that it provides a forward bias to the truck, which facilitates pulling or pushing the truck in rough terrain.

Truck 11 is provided with strap lugs 68 for strapping both the patient and the litter to truck 11. In addition, truck 11 is provided with a holder 69 for the pole of an intravenous feeding or medication administering mechanism.

Figure 3:
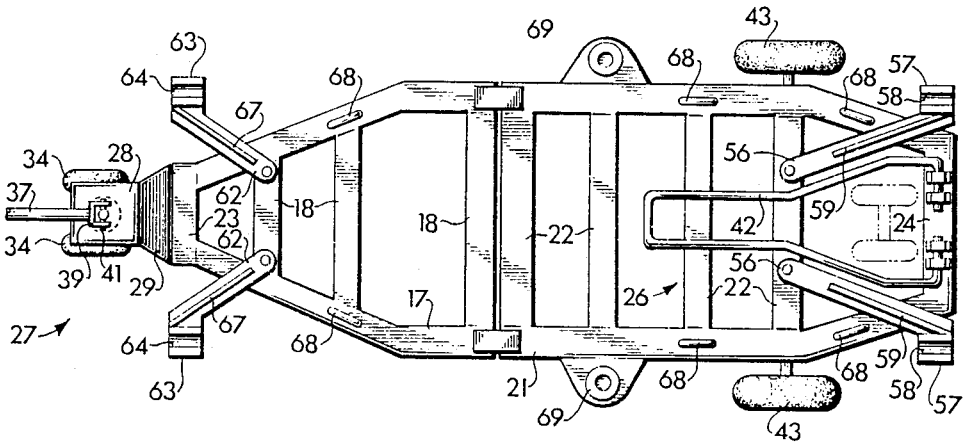
FIG. 3 is a plan view of the truck of the present invention.

FIG. 3 depicts how wheels 34, 34 shown in dashed outline are accommodated in the space 26 when truck 1 is FIG. 3 depicts how wheels 34, 34 shown in dashed outline are accommodated in the space 26 where truck 11 is folded. In addition, for illustrative purposes only, plates 56, 56 and 62, 62 are shown fixed to the frame of truck 11 so that the notches 58, 58, are aligned with notches 64, 64, with their longitudinal axes substantially parallel to the longitudinal axis of truck 11.

From the foregoing it can be seen that the truck of the present invention is capable of adapting to and supporting a number of different types of litters, that it requires a minimum of manpower, i.e., one man, to transport a patient and that is readily deliverable, to even remote areas. The truck of the invention may also be equipped with skis, for examples, for rescuing injured personnel in snow covered areas.

The principles of the present inventic,n have been shown in an illustrative embodiment thereof; however, variations and modifications can be made to the disclosed embodiment without departing from the spirit and scope of the invention as defined by the following claims.

I claim:

1. An emergency hand truck comprising an elongated flat frame member having front and rear sections, a first pair of wheels mounted at the front of said front section and a second pair of wheels mounted approximately at the rear of said rear section, said first pair of wheels being swivelly mounted to said frame, means for steering said truck comprising means for swiveling said first pair of wheels, and means for supporting a litter on said truck above said frame comprising first and second elongated flat plates, each having one end mounted to said frame adjacent a front corner thereof, and third and fourth elongated flat plates each having one end mounted to said frame adjacent a rear corner thereof, each of said flat plates having an upstanding support arm having its lower end mounted to the distal end of said flat plate and having a notch formed in its upper end, and a support plate extending from said support arm toward the mounted end of said flat plate, said support plate having a concave upper edge curving down and away from said support arm, whereby said means for supporting a litter supports the handles of a stretcher in the notched ends of said support arms, or supports a Stokes basket type litter on the curved upper edges of said support plates.

2. An emergency hand truck as claimed in claim 1 wherein said one end of each of said elongated flat plates is swivelly mounted to said frame.

3. An emergency hand truck as claimed in claim 1 wherein said front and rear sections of said frame are hinged together by a mounting hinge whereby said front section can be folded against said rear section, to form a closed frame, or unfolded to an open frame position with said front section parallel and coextensive with said rear section.

4. An emergency hand truck as claimed in claim 3 and further including means for locking said front and rear sections in the open frame position.

5. An emergency hand truck as claimed in claim 4 wherein said means for locking comprises at least one barrel bolt.

6. An emergency hand truck as claimed in claim 4 and further including means for relieving stress on said mounting hinge.

7. An emergency hand truck comprising, in combination, an elongated flat frame member formed of a plurality of hollow tubular members, and having a front and rear section hinged together by means of a mounting hinge, said front section having a tapered front end and said rear section having a tapered rear end, a first pair of wheels swivelly mounted to said tapered front end, and a second pair of wheels mounted adjacent said tapered rear end at either side thereof, means for steering said truck comprising means for swiveling said first pair of wheels, and means for supporting a litter on said truck above said frame comprising first and second elongated flat plates each having one end mounted to said frame on the front section adjacent said front end at either side thereof, and third and fourth elongated flat plates each having one end mounted to said frame on the rear section adjacent said rear end at either side thereof, the unmounted end of each of said flat plates having an upstanding support arm having a bottom end mounted to said plate and a top end adapted to receive a handle of a litter, and a support plate having a concave upper edge curving down and away from said support arm toward said one end of said flat plate mounted to said frame.

8. An emergency hand truck as claimed in claim 7 wherein said frame has an open position with said front and rear sections aligned, and a closed position, and including means for locking said frame in the open position.

9. An emergency hand truck as claimed in claim 8 wherein said means for locking comprises a barrel bolt.

10. An emergency hand truck as claimed in claim 7 and further including a handle member swivelly mounted to said tapered rear end.

* * * * *